US006446968B1

(12) United States Patent
Koch

(10) Patent No.: US 6,446,968 B1
(45) Date of Patent: Sep. 10, 2002

(54) THEMED BOARD GAME

(76) Inventor: Paul W. Koch, 24920 Fairmount, Dearborn, MI (US) 48124

( * ) Notice: Subject to any disclaimer, the term of this patent is extended or adjusted under 35 U.S.C. 154(b) by 32 days.

(21) Appl. No.: 09/652,848

(22) Filed: Aug. 31, 2000

(51) Int. Cl.[7] ..... A63F 3/00

(52) U.S. Cl. ..... 273/243; 273/242; 273/248; 273/251; 273/252; 273/254

(58) Field of Search ..... 273/243, 242, 273/248, 251, 252, 254

(56) References Cited

U.S. PATENT DOCUMENTS

| | | | | | |
|---|---|---|---|---|---|
| 1,464,019 | A | * | 8/1923 | Wenzel | 273/146 |
| 2,026,082 | A | * | 12/1935 | Darrow | 273/134 |
| 3,779,556 | A | * | 12/1973 | Johmann | 273/134 A |
| 4,012,046 | A | * | 3/1977 | Liket | 273/134 C |
| D261,614 | S | * | 11/1981 | Vallome | D9/311 |
| 4,337,861 | A | * | 7/1982 | Smart | 206/579 |
| 4,368,889 | A | * | 1/1983 | Reker, Jr. | 273/243 |
| 4,545,582 | A | * | 10/1985 | Andrews | 273/238 |
| 4,900,031 | A | * | 2/1990 | Wohl | 273/243 |
| 4,915,391 | A | * | 4/1990 | Aharonian | 273/256 |
| 4,932,668 | A | * | 6/1990 | Stewart | 273/256 |
| 4,940,239 | A | * | 7/1990 | Tuttle | 273/243 |
| D312,483 | S | * | 11/1990 | Kelly | D21/54 |
| 5,064,200 | A | * | 11/1991 | Martinez | 273/243 |
| 5,417,432 | A | * | 5/1995 | Dwyer | 273/299 |
| 5,435,565 | A | * | 7/1995 | Benaderet | 273/243 |
| 5,662,328 | A | * | 9/1997 | Pecoy | 273/242 |
| 5,683,087 | A | * | 11/1997 | Henshaw et al. | 273/237 |
| 5,707,239 | A | * | 1/1998 | Butler | 434/191 |
| 5,722,658 | A | * | 3/1998 | Talmage et al. | 273/243 |
| 5,743,528 | A | * | 4/1998 | Downey-Jerome | 273/249 |
| 5,749,582 | A | * | 5/1998 | Fritz et al. | 273/246 |
| 5,865,436 | A | * | 2/1999 | Conti | 273/241 |
| 5,865,676 | A | * | 2/1999 | Sally | 463/6 |
| 5,882,008 | A | * | 3/1999 | Siegesmund | 273/249 |
| 5,924,693 | A | * | 7/1999 | Beaumier et al. | 273/245 |
| 6,086,068 | A | * | 7/2000 | Ayres et al. | 273/236 |
| 6,273,425 | B1 | * | 8/2001 | Westfall et al. | 273/459 |
| 6,290,230 | B1 | * | 9/2001 | Anthony | 273/447 |

FOREIGN PATENT DOCUMENTS

| | | | | |
|---|---|---|---|---|
| GB | 586817 | * | 4/1947 | |
| GB | 2 186 497 A | * | 8/1987 | A63F/3/00 |
| GB | 2 219 748 A | * | 12/1989 | A63F/3/00 |

OTHER PUBLICATIONS

Koplow Games—Dice catelog #10—Nov. 22, 1999—p. 36.*

Rules And Explanation Sheet for CLUE™, Parker Brothers—HASBRO Games, pawtucket, RI, 02862—1986.*

Harry Potter Board Game—Instructions (2 pages) And Checklist Pad (1 page)—Mattel, Inc. of El Segundo, CA 90245–2000.*

* cited by examiner

*Primary Examiner*—Benjamin H. Layno
*Assistant Examiner*—Dolores R Collins
(74) *Attorney, Agent, or Firm*—Peter D. Keefe

(57) ABSTRACT

A themed board game, is family oriented and recreates the fun and wonder of Halloween, preferably for 3 to 8 players (ages preferably 8 and older), and takes about one hour to play. A game board has printed thereon a thematic scene, a preferred example of which being a Haunted House. Twin sets of cards each include three category groups: a place category (depicted as locations of the Haunted House), an entity category (Halloween related persons or things, as for example a werewolf, a witch, a ghost, etc.), and an event category (Halloween related occurrences, as for example a scream, a laugh, a howl, an odor, etc.). A randomizing instrument is provided, preferably in the form of a single die which preferably may uniquely include a Halloween indicia in place of the six dots face (as for example a cat or a jack-o-lantern). Three cards, one from each category are secretly selected, the indicia of which form a Haunting Mystery. Players try to solve the Haunting Mystery by deducing which of the cards in play have no matching duplicate. This objective is achieved in the course of play by a careful process of elimination of possibilities by each player using his/her "Tracking Chart".

3 Claims, 7 Drawing Sheets

THEMED BOARD GAME

BACKGROUND OF THE INVENTION

1. Field of the Invention

The present invention relates to board games, and more particularly to a board game including a themed game board depicting a plurality of places and two identical sets of playing cards (each card having a matching card) in which players vie with each other to solve a multi-part mystery, the mystery being based upon deducing which cards, randomly selected cards at the game start, have no match.

2. Description of the Prior Art

Board games are an excellent form of family entertainment. One of the better known board games is MONOPOLY (trademark of Parker Bros.), which is described in U.S. Pat. No. 2,026,082 to Darrow, dated Dec. 31, 1935. Board games include a game board having play indicia printed thereon, games pieces (usually one uniquely specific to each player), frequently other games pieces, dice or a single die to provide an element of chance, and frequently a set of cards to provide an element of chance coupled with information germane to the play of the game. Some board games also provide other articles of play, such as play money. The object of play of board games is variously related to the rules of play of the particular board game, but generally involves a single player achieving first a predetermined goal, which for example may be the acquisition of a selected game board location, collection of a certain amount of game pieces, the accumulation of a highest amount of play money, etc.

One type of board game that elicits a great deal of fun in the course of its play is the board game CLUE (trademark of Parker Bros.). In CLUE, the game starts with the murder of a game character, and the objective of the game is to solve a three part query: which game character committed the murder (selected from a group of game character "suspects"), where was the murder committed (selected from a number of rooms of a mansion indicated by a floor plan depiction on the game board), and what weapon was used to commit the murder (selected from a group of various weapons). The articles of play include: a game board with a mansion floor plan indicia thereon which depicts 9 rooms; 6 different colored token play pieces (one for each suspect), 6 different weapon play pieces, a single deck of nonidentical cards comprising three categories, one card for each of the 6 suspects (a first category), 6 weapons (a second category) and 9 rooms (a third category), a detective's notebook score sheet, a "case file" envelope, and 1 die. At the start of play, the cards are separated into three piles sorted according to the categories of cards, one card from each pile is secretly placed in the case file, the object being for the players to make an accusation which includes three categories and names the three cards in the case file. In the course of play, the die is in-turn rolled and players in-turn place their tokens on a room location. Once in a room an in-turn player makes a three-part suggestion naming that room, a suspect and a weapon. The other players then try, in-turn, to prove the three-part suggestion false by showing the in-turn player a card indicating one of the named categories. Such a card showing is proof that the card is not in the case file, and the in-turn player makes a note to that effect on his/her notebook score sheet, and his/her turn ends. As the game progresses, enough information is amassed for a player to make an accusation. If that player's accusation is correct he/she wins, if not he/she cannot win the game.

Although many prior art board games are quite entertaining, what remains needed is a themed board game which provides great fun and excitement as players compete with each other to solve a multi-part mystery based upon deducing which randomly selected cards of two identical sets of cards have no match.

SUMMARY OF THE INVENTION

The present invention is a themed board game including a randomizing instrument, such as for example a die (preferred) or dice, a spinner or other random number indicating device, a plurality of game pieces, a game board having a themed place depiction which depicts a plurality of places and further including two identical sets of playing cards (each card having a matching card) in which players vie with each other to solve a multi-part mystery, the mystery being based upon deducing which cards, randomly selected cards at the start of the game, have no match. Each card of each set has mutually differing indicia thereon, wherein each card of each set has an indicia match with a respective card of the other set. The cards are divided into a plurality of categories, one category including a place category. The cards of each set of cards of the place category have place indicia corresponding to the places of the place depiction.

In operation, one card from each category is randomly selected and secreted. The indicia of these secreted "mystery" cards form the multi-part mystery to be solved. The remaining cards are distributed among the players. An in-turn player actuates the randoming instrument, as for example by rolling at least one die, and moves his/her game piece to a selected place of the place depiction consistent with moves rules. The in-turn player then queries of the players a multi-part question including at least one first part taken from a selected card indicia from at least one category other than the place category and a second part taken from the place category in the form of the place of the game board place depiction where the in-turn player's game piece is resting, and then shows a card having indicia of a part the multi-part question. The other players then sequentially show a card having indicia of the multi-part question, if such a card is held. Matching shown cards are then discarded from play, otherwise cards are returned to each player, respectively. A next go player then becomes the in-turn player and play as aforesaid continues until a player announces a solution to the multi-part mystery by saying aloud a sentence incorporating the card indicia presumed to be of the secreted "mystery" cards. If correct, this player wins; if incorrect, his/her cards are revealed and play continues until the mystery is solved by another player.

The preferred embodiment of the themed board game according to the present invention is a Halloween themed board game, hereinafter referred to simply as a "Halloween game". The Halloween game is a family-oriented seek and find board game which recreates the fun and wonder of Halloween, preferably for 3 to 8 players (ages preferably 8 and older), and takes about one hour to play.

A game board has printed thereon a Halloween thematic scene, a preferred example of which being a "Haunted House" having Victorian and Gothic aspects with appurtenances constituting a plurality of places, as for example a porch, rooms, a balcony, an attic, etc. A plurality of game pieces, one used by each player, have a Halloween theme configuration, as for example a pumpkin, a witch, a ghost, etc. Twin sets of cards are provided (that is, each set is a duplicate of the other), each set having three category groups: a place category (wherein each place indicia card thereof has indicia thereon indicative of a respective place of the Haunted House, there being one card in each set for each place, respectively), an entity category (wherein each entity indicia card thereof has indicia thereon indicative of a respective Halloween related entity, as for example a werewolf, a witch, a ghost, etc., there being one card in each set for each entity, respectively), and an event category (wherein each event category card thereof has indicia thereon indicative of a respective Halloween related occurrence, as for example a scream, a laugh, a howl, an odor, etc., there being one card in each set for each event, respectively). At least one die is provided (one die being preferred), which preferably may uniquely include a Halloween indicia in place of the six dots face (as for example a cat or a pumpkin). A first container, preferably having a book configuration, is provided as a receptacle for three "mystery" cards selected at the game start. The "mystery" cards consist of one card from each category, the indicia of which is unknown to the players. A second container, preferably having a coffin configuration, is provided as a receptacle for cards discarded in the course of the game.

The object of the Halloween game is to deduce and announce a "Haunting Mystery" which is a statement indicative of the indicia of three "mystery" cards resident in the first container. This objective is achieved in the course of play by a careful process of elimination of possibilities by each player using his/her "Tracking Chart".

An example of operation of the Halloween game according to the present invention is as follows.

The cards are sorted by category into category piles and then each category pile is shuffled. A card from each category pile is placed into the first container without the indicia thereon being known to any player. The cards (all categories) are then grouped together, shuffled and then sequentially dealt to the players. The players take turns. Each in-turn player rolls a die and then moves his/her game piece a number of moves equal to or less than the die roll score to a selected (by "selected" is meant a player preferred) place of the "Haunted House" depiction. The in-turn player then asks out loud a two-part question relating the cards he/she holds as he/she plays a single card face up relative to the playing surface (ie., a table). For example: "Has anyone seen a ghost (part 1) in the kitchen (part 2)?" This in-turn player must have a shown (or played) card with an indicia which is either indicative of part 1 or part 2 of the two-part question. To play a Place indicia card, the in-turn player must have his/her game piece on that location. The in-turn player must then show a card from his/her hand with indicia of one of the two parts of the two-part question. All the other players sequentially respond by saying "yes" and showing a corresponding card if they have one, or "no" only if they have no corresponding card to either part 1 or part 2 of the question. If a card is shown by a player which matches a card shown by any other player, then these two cards become discarded or "dead" cards that are placed into a "Dead Card Pile" in the second container and are now out of play for the rest of the game. Since these two identical discarded cards are known to all the players, the place, entity or event category indicia thereon cannot be in the first container, preferably referred to as a "Book of Spells", and, therefore, cannot form a part of the three-part Haunting Mystery. The players should notate their respective Tracking Chart accordingly with this information or any other information they may have deduced on this turn. All non-matching cards are returned to each respective player's hand. The game continues with each player sequentially being the in-turn player. An in-turn player may announce what he/she thinks is the Haunting Mystery by making a three-part statement including an entity category, an event category and a place category as depicted by the card set indicia. That player may then look into the "Book of Spells" to see if these "mystery" cards are there. If they are, then that player wins, and the game concludes. If not, the player is out of the game, his/her cards are made known to the remaining players, and play continues.

Accordingly, it is an object of the present invention to provide a board game which provides the enchantment of Halloween in the course of play.

It is an additional object of the present invention to provide a themed board game wherein an object of the game is to deduce a multi-part mystery using a game board depiction of a plurality of places of a place category and two identical decks of cards having multiple categories including the place category.

These, and additional objects, advantages, features and benefits of the present invention will become apparent from the following specification.

DETAILED DESCRIPTION OF THE PREFERRED EMBODIMENT

A preferred embodiment of the present invention is a Halloween theme board game, and, as mentioned hereinabove, is referred to herein simply as a "Halloween game". The Halloween game is a family-oriented seek and find board game which recreates the fun and wonder of Halloween, preferably for 3 to 8 players (ages preferably 8 and older), and takes about one hour to play.

Figure 1:
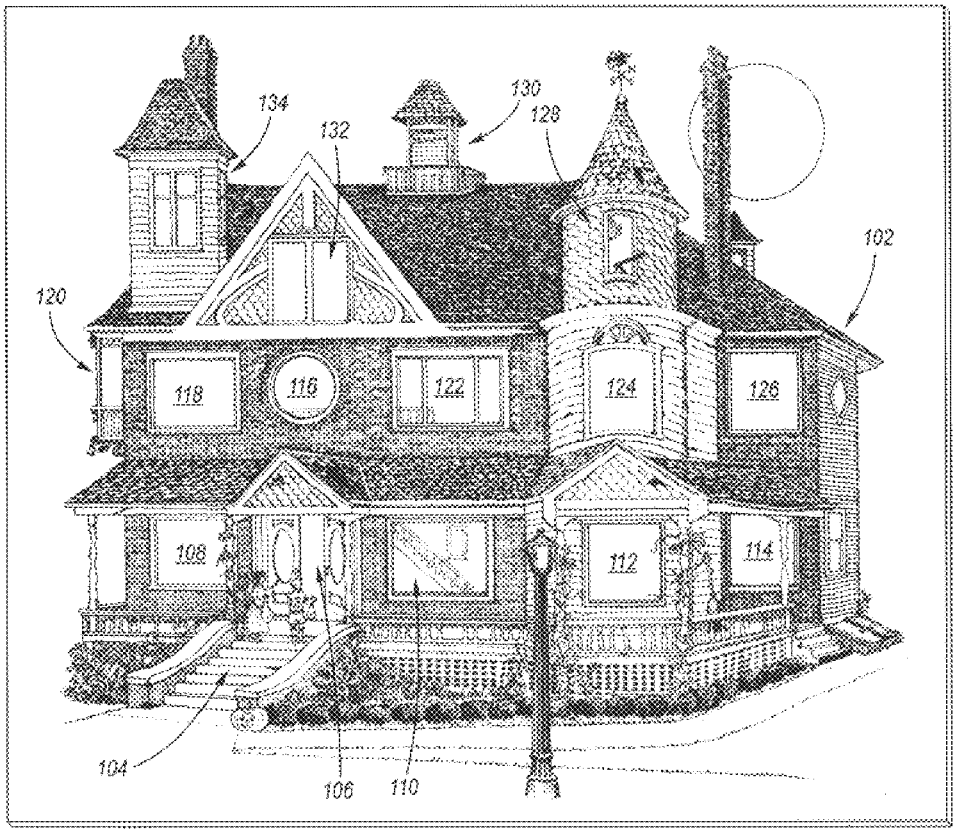
FIG. 1 is a plan view of a game board according to the present invention, showing thereon a haunted house depiction.

Referring now to the Drawing, FIG. 1 depicts a game board 100, having imprinted thereon a "Haunted House" depiction 102, having classic Victorian and Gothic features. The Haunted House 102 depicts various places associated therewith, preferably including for example: a porch place 104, a foyer place 106, a living room place 108, stairs place 110, a dining room place 112, a kitchen place 114, a hall place 116, a library place 118, a balcony place 120, a wash room place 122, a bedroom place 124, a laboratory place 126, a tower place 128, a belfry place 130, an attic place 132 and an art studio place 134. Other places may be depicted. It is preferred for each place to be suggestively depicted (although not every place in FIG. 1 includes a depiction). For example, the stairs place 110 clearly are seen to be stairs, the porch place 104 is clearly seen to be a porch, and while not explicitly shown, the other places are likewise preferably explicit; for example, the laboratory place 126 could be rendered explicit by a depiction of bubbling flasks over burners. It is preferred for a set pattern of moves to be established, as for example by a moves diagram imprinted on the Tracking Chart 136 (see FIG. 10) and/or as for example by moves indicia imprinted on the Haunted House depiction 102 (such as by arrows between places) or for example by the aforementioned moves diagram 136 being imprinted on the game board 100 adjacent the Haunted House depiction.

Figure 4:
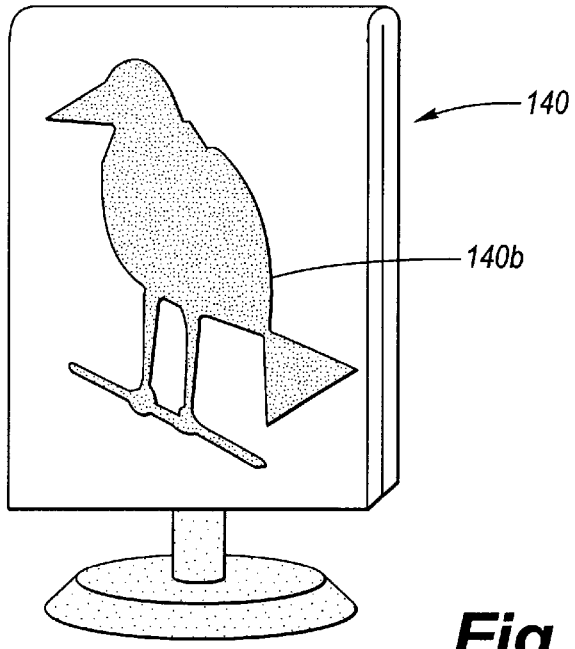
FIG. 4 is a perspective view of a game piece according to the present invention.

A plurality of game pieces are provided, one for each player, for the purpose of identifying each player's game piece placement upon a place of the Haunted House. FIG. 4 depicts an example of a game piece 140. It is preferred for the game pieces to have mutually distinctive Halloween thematic depictions and/or configurations. As for example, a Halloween theme depiction in the form of a crow 140*b*, as shown at FIG. 4, wherein the depiction is identical on both sides, although only one side is visible in the view. FIGS. 5 and 6A through 6F show alternative thematic depictions which may be placed upon the game pieces or three-dimensionally configured into game pieces, the form of a black cat 154, a jack-o-lantern 160*a*, a crescent moon 160*b*, a flying witch 160*c*, an owl 160*d*, a flying bat 160*e*, and a ghost 160*f*. Other Halloween related thematic depictions and/or configurations may be used as game pieces. The game pieces may be economically made of folded, and depicted upon cardboard on posts, as shown at FIG. 4, or may be deluxe made of configured and/or depicted upon injection molded plastic.

Figure 5:
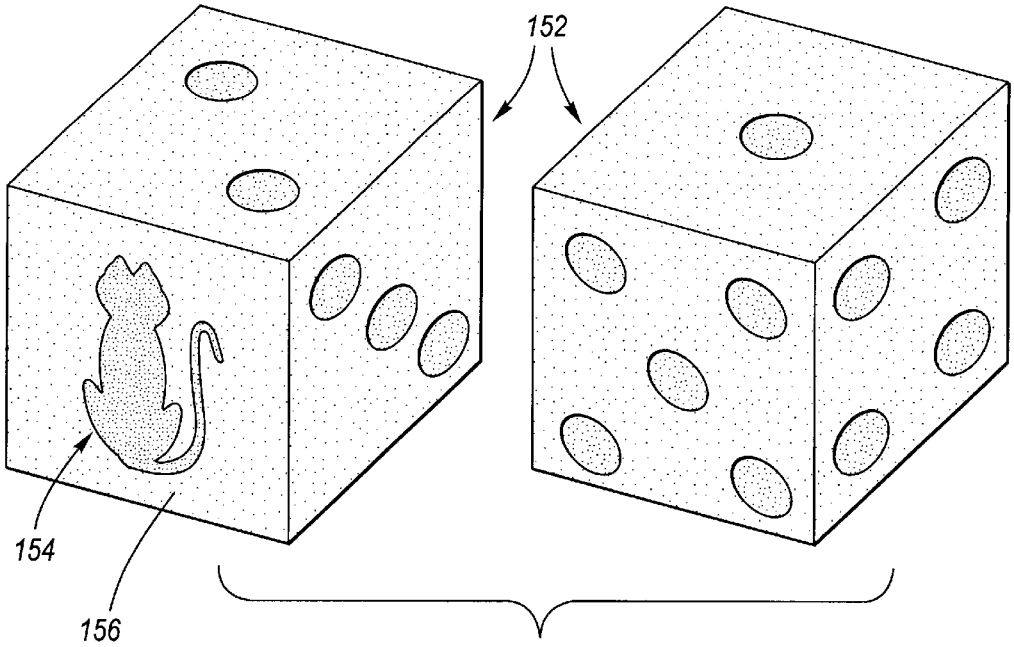
FIG. 5 is set of perspective views of a die according to a preferred form of the present invention, wherein a depiction replaces one of the dotted faces.
Figure 6A:
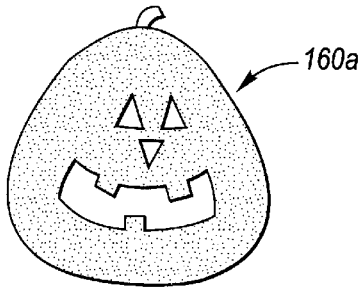
FIGS. 6A through 6F depict plan views of depictions according to the present invention suitable for use with either game pieces and/or the die.
Figure 6B:
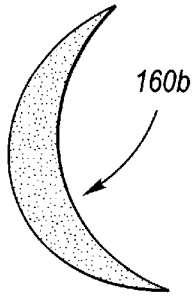
Figure 6C:
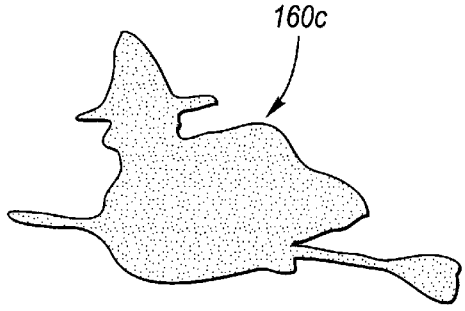
Figure 6D:
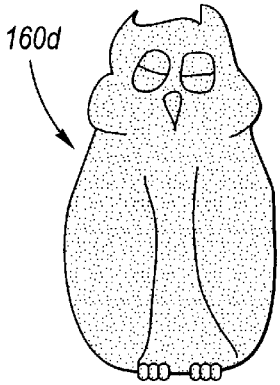
Figure 6E:
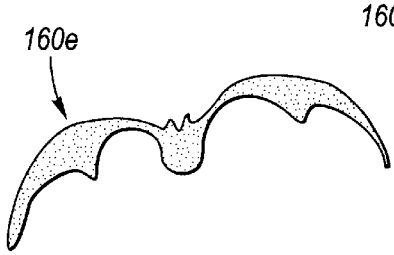
Figure 6F:
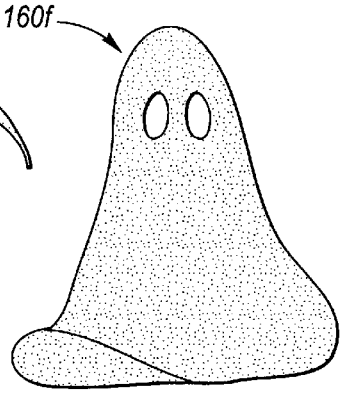

The movement of the game pieces about the Haunted House is limited by chance offered by actuation of a randomizing instrument, such as for example the roll of dice, the roll of a die (preferred) or the spin of a spinner (spinners are well known randomizing instruments, see for example FIG. 4 of U.S. Pat. No. 5,865,676), etc. In this regard, an in-turn player rolls the die and the number of dots represents the maximum places he/she may move to, per moves indicia or the moves diagram 136. In order to extend the Halloween theme to the die, a unique Halloween die 152 is preferably provided by having imprinted on a face thereof a Halloween related depiction, as shown at FIG. 5. For example, a black cat 154 may be imprinted in place of the six dots face 156 normally present on a die, as shown at FIG. 5. Accordingly, when the Halloween depiction is face up after a roll, the players all realize this is the six dot count face. Other Halloween related depictions may be used (see for example, and not by way of limitation, the depictions of FIGS. 4 and 6A through 6F) which are suitable for imprinting on a Halloween die according to the present invention.

Figure 7:
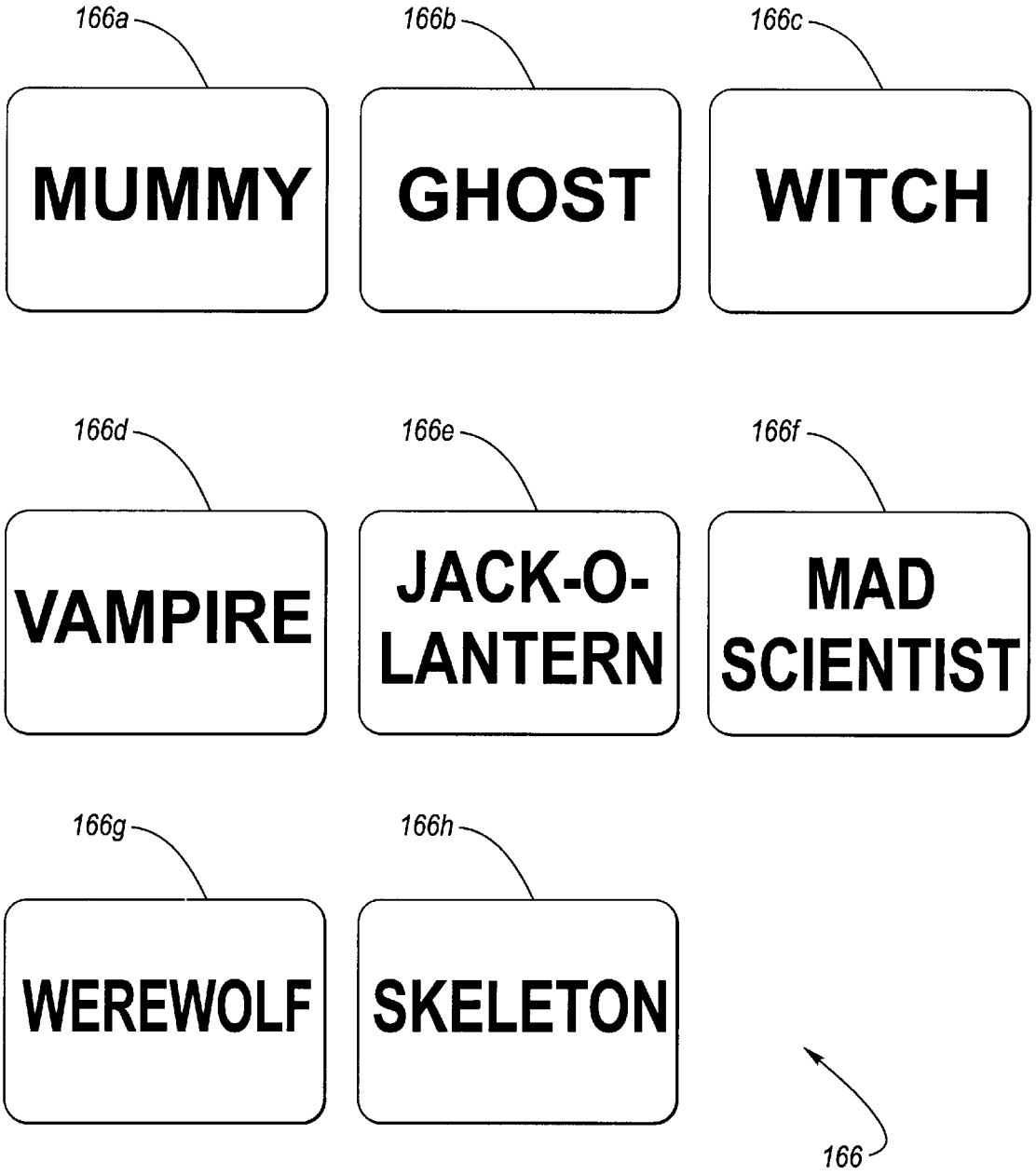
FIG. 7 is a plan view of a group, of two identical groups, of entity category cards according to the present invention.
Figure 8:
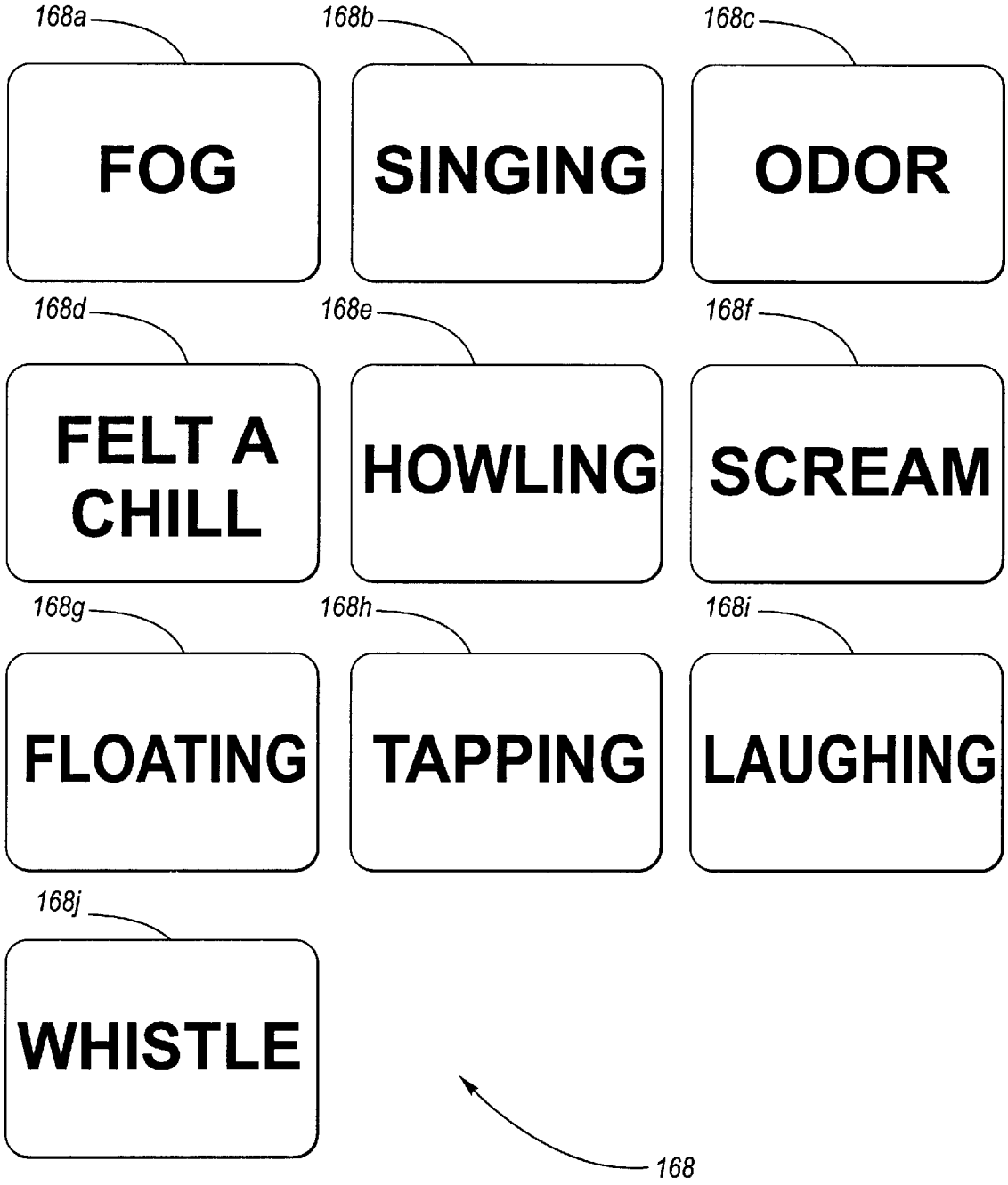
FIG. 8 is a plan view of a group, of two identical groups, of event category cards according to the present invention.
Figure 9:
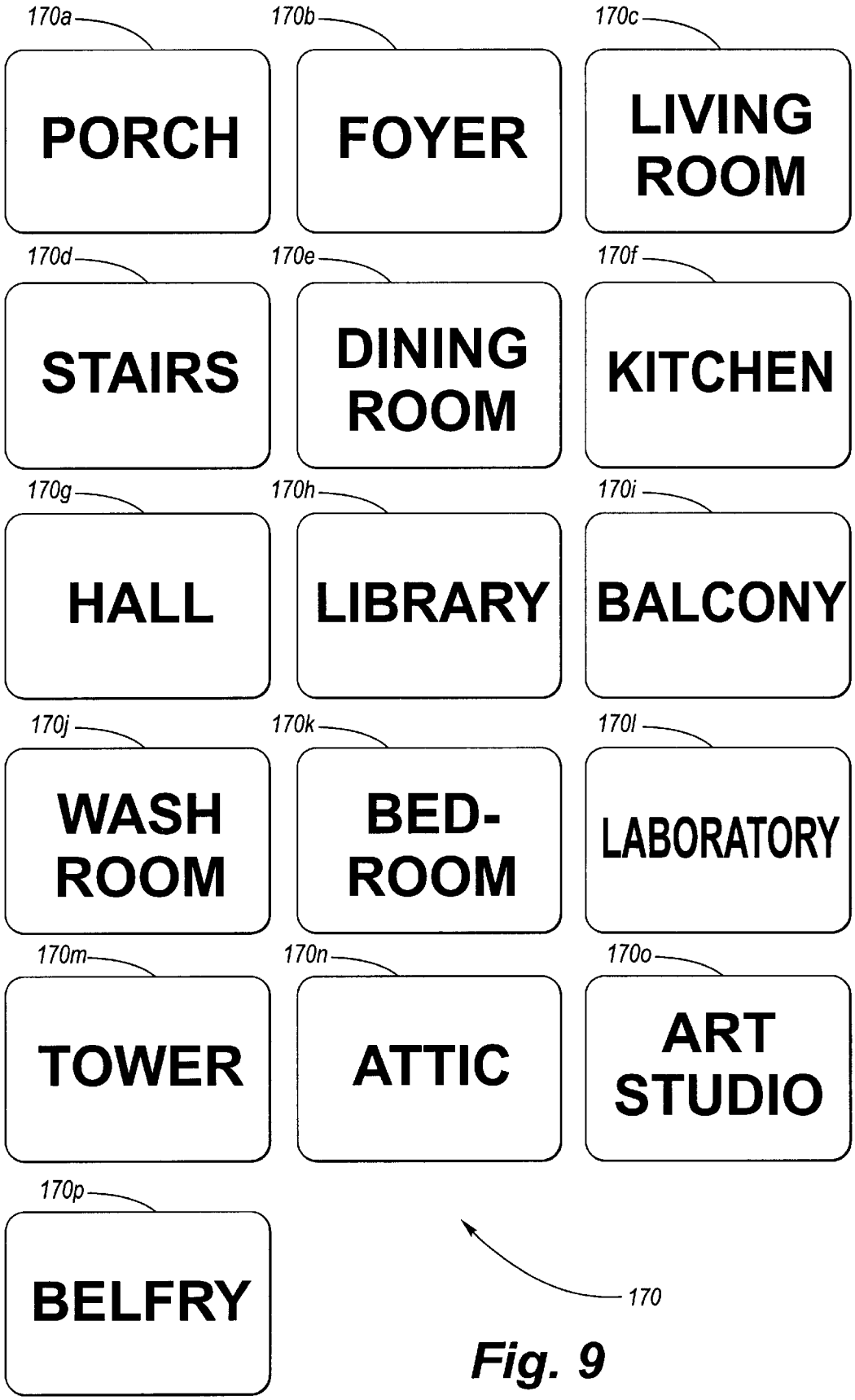
FIG. 9 is a plan view of a group, of two identical groups, of place category cards according to the present invention.

Two identical sets of cards are provided, each set including three category groups of cards. The category groups are: an entity category group 166 (see FIG. 7), an event category group 168 (see FIG. 8), and a place category group 170 (see FIG. 9). Each category group has a plurality of mutually different indicia cards germane to that category group. For example, for the entity category group 166 by way of preference there is included a mummy indicia card 166*a*, a ghost indicia card 166*b*, a witch indicia card 166*c*, a vampire indicia card 166*d*, a jack-o-lantern indicia card 166*e*, a mad scientist indicia card 166*f*, a werewolf indicia card 166*g*, and a skeleton indicia card 166*h*. The number of entity indicia cards may be varied, as may the entity indicia used. For example, entity depictions, rather than, or together with, entity identifying words may be used. Further for example, for the event category group 168 by way of preference there is included a fog indicia card 168*a*, a singing indicia card 168*b*, an odor indicia card 168*c*, a felt a chill indicia card 168*d*, a howling indicia card 168*e*, a scream indicia card 168*f*, a floating indicia card 168*g*, a tapping indicia card 168*h*, a laughing indicia card 168*i*, and a whistle indicia card 168*j*. The number of event indicia cards may be varied, as may the event indicia used. For example, event depictions, rather than, or together with, event identifying words may be used. Finally for example, for the place category group 170 by way of preference there is included a porch indicia card 170*a*, a foyer indicia card 170*b*, a living room indicia card 170*c*, a stairs indicia card 170*d*, a dining room indicia card 170*e*, a kitchen indicia card 170*f*, a hall indicia card 170*g*, a library indicia card 170*h*, a balcony indicia card 170*i*, a wash room indicia card 170*j*, a bedroom indicia card 170*k*, a laboratory indicia card 1701, a tower indicia card 170*m*, an attic indicia card 170*n*, an art studio indicia card 170*o*, and a belfry indicia card 170*p*. There is a place indicia card corresponding to each place of the Haunted House depiction 102. The number of indicia cards may be varied, as may the place depictions. For example, the cards may have place indicia in the form of place depictions similar to those shown in the Haunted House depiction 102, rather than, or together with, place identifying words. Also, the number of places depicted on the game board may be varied, as may the depiction of the places, so long as there is a correspondence between the place card indicia and the places of the game board depiction. There are two of each indicia card, amounting to the aforementioned two sets of cards (FIGS. 7, 8 and 9 depicting one of the two identical sets of cards).

Figure 2:
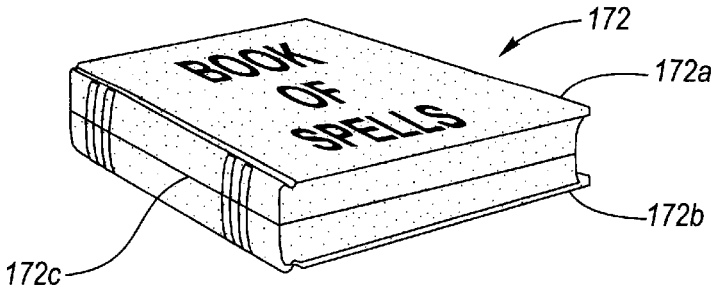
FIG. 2 is a perspective view of a container for holding selected "mystery" cards, the indicia of which defines a multi-part mystery to be solved according to the present invention.
Figure 3:
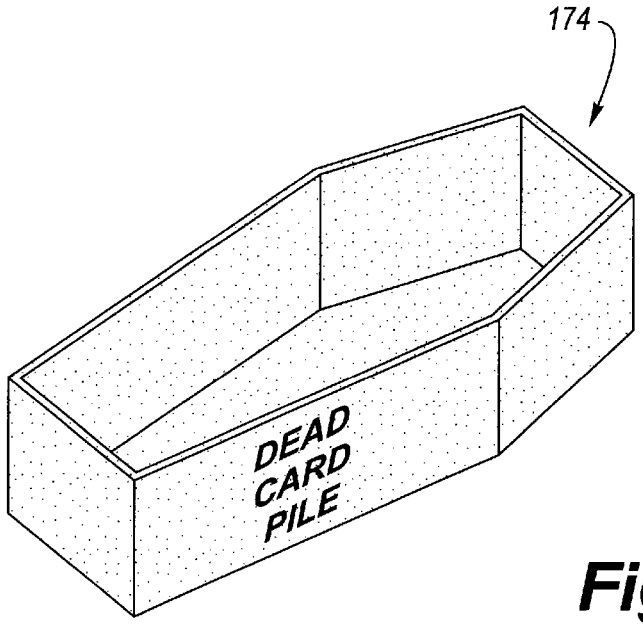
FIG. 3 is a perspective view of a container for holding out of play discarded cards.

The object of the Halloween game is to solve a "Haunting Mystery" constituting a three-part statement reflecting the card indicia from one card each of the three categories, these three cards being referred to as the "mystery" cards. The indicia of the three "mystery" cards are unknown to the players and these cards are secreted in a container intended to keep the indicia of the "mystery" cards hidden unless intentionally allowed to be viewed in the course of play. A preferred "mystery" card container is shown at FIG. 2, wherein a cardboard, plastic or other material book shaped "Book of Spells" container 172 has an upper portion 172*a*, a lower portion 172*b* and a living hinge 172*c* connecting the upper and lower portions, wherein the upper and lower portions are openable at the living hinge to receive and conceal therein the "mystery" cards.

In the course of play, certain of the cards will become out of play. These discarded or "dead" cards are retained in another container. A preferred container for the dead cards is a coffin shaped "Dead Card Pile" container 174 (which need not include a lid, although one could be included). The Dead Card Pile container 174 may be stand-alone cardboard, plastic, or other material piece, or a pocket in the game box which is used to package the Halloween game.

Figure 10:
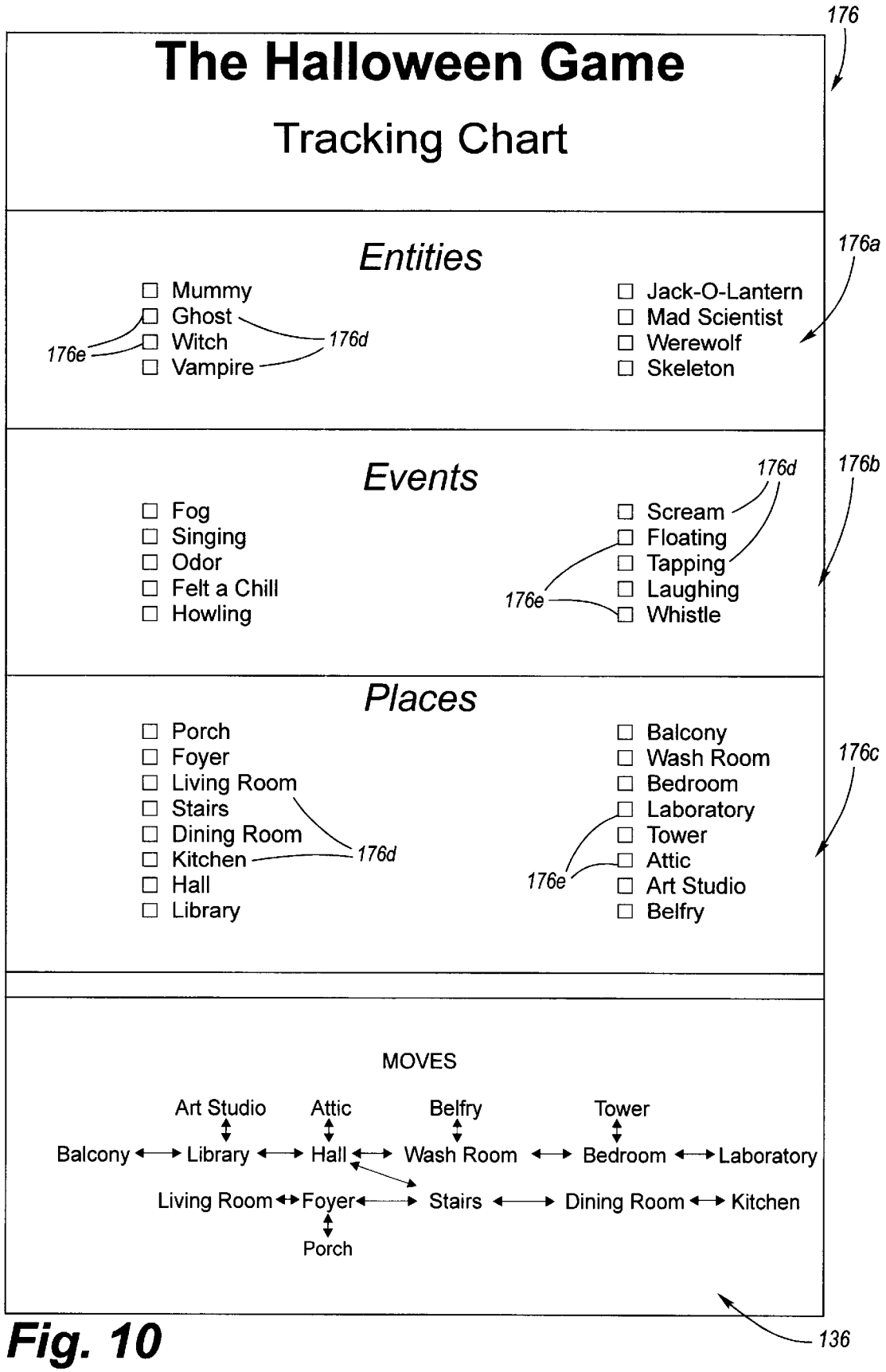
FIG. 10 is a plan view of a "Tracking Chart" according to the present invention, wherein the Tracking Chart includes a moves diagram also according to the present invention.

As the course of play of the Halloween game ensues, clues as to the identity of the "mystery" card indicia may be inferred by the players. In order to record this information in an orderly fashion, a "Tracking Chart" is given to each player to use during the game. An example of a Tracking Chart 176 is shown at FIG. 10, wherein the Tracking Chart is divided into three sections 176*a*, 176*b*, 176*c*, one section for each card category. In each section, all the card indicia of its respective card category are indicated by a representation thereof 176*d*, with a marking place 176*e* adjacent thereto, respectively. A writing instrument (not shown) is used by each player to mark his/her Tracking Chart 176. As discussed hereinabove, it is preferred to imprint the moves diagram 136 on the Tracking Chart 176.

The operation of the Halloween game according to the preferred embodiment of the present invention will now be presented.

The game centers around the Book of Spells 172, which contains the answer to the Haunting Mystery. An example of a Haunting Mystery is: "I saw a ghost laughing on the stairs." Notice that the Haunting Mystery has three parts: an entity part, and event part and a place part, each part coinciding with the card indicia of the three card categories. In the above example, the three "mystery" cards are the Ghost indica card 166*b*, the Laughing indicia card 168*i* and the Stairs indicia card 170*d*, wherein the "ghost" of the Haunting Mystery is a card indicia of the entity card category group 166; the "laughing" of the Haunting Mystery is a card indicia of the event card category group 168; and the "stairs" of the Haunting Mystery is a card indicia of the place card category group 170.

To randomly establish a Haunting Mystery for each game about to be played, at the beginning of the game one card from each of the three card categories is chosen at random and secretly placed in the Book of Spells. For example, the cards are sorted into three card piles, each pile containing card indicia of only one card category, the cards are shuffled and then a card from each card pile is chosen without looking. The non-secreted cards are then grouped all together and again shuffled. These cards are then distributed, face down, by sequential dealing or by sequential taking by the players, such that only each player knows the indicia of his/her cards. Each player should have by now selected, and be in possession of, a game piece 140, and have placed it on the porch 104.

Now, it's time to enter the Haunted House 102 to search for clues to the Haunting Mystery. Since there are two identical sets of cards, each card has a match. However, because one card from each card category is now secreted in the Book of Spells, the "mystery" cards of the Haunting Mystery are unmatched with the other cards in play. It is these unmatched cards that reveal the Haunting Mystery, and they are now somewhere in the players' hands. In the course of play, the players search for clues to deduce which of the cards are unmatched by eliminating all the matched cards. For example, if two players both play the Tower indicia cards, then these two cards are removed from the game because the Tower indicia cannot be part of the Haunting Mystery, and all the players know this information and mark their Tracking Chart accordingly. Eventually as the game play ensues, most of the matched cards are eliminated, revealing the Haunting Mystery. When an in-turn player thinks he/she has in mind the three unmatched cards, he/she then announces what that player thinks is the Haunting Mystery. This announcement must be in the form of a three-part statement, said aloud, which includes the three card indicia of the "mystery" cards located in the Book of Spells. If correct, that player wins; if incorrect, that player is out of the game. Much of the excitement of the Halloween game comes from the fact that all the players are participating during every turn. Even though it's someone else's turn to roll the die, move and ask a question, new information is always being revealed to the players, so all players are constantly up-dating their respective Tracking Charts. All players who are paying attention will be close to winning the game near its conclusion. Therefore, it becomes somewhat of a race where guessing could lead to success or failure and the roll of a die determines a player's chances of getting to the correct place first in time to open the Book of Spells and win the game.

The die roll high score player goes first by again rolling the die. The die score sets the maximum number of places his/her game piece can move, consistent with the allowed moves (ie., as indicated on the moves diagram 136). In this regard, the movement can be equal to or less than the die number, or even no movement at all. The only game piece positions which are valid are those places of the Haunted House corresponding to the place card indicia (FIG. 9). In the preferred example, there are 16 valid places around the Haunted House that the players can move to and rest a game piece upon, as defined for example by the moves diagram 136 (compare FIGS. 1 and 10). Allowed movements include, for example, restricting game piece movement between upstairs and downstairs only between the hall place 16 and the stairs place 110. Players may only move once per turn. The place that an in-turn player chooses to move to is mostly determined by the cards he/she is holding, because these are the only cards he/she can play, and at the end of a move a card must be played in order to ask a two-part question.

After moving, the in-turn player chooses one card to play face up in front of him/her. In this regard, in order to play a place card, the player must have his/her game piece at that place of the Haunted House; otherwise, any event or entity card may be played. The in-turn player decides what two-part question to ask the other players, wherein one part of the question must include the card indicia of the played card. Formulating the two-part question includes thinking about how best to glean hints to the Haunting Mystery, based on what card is played, where the game piece is placed, what cards are held and what information has already been marked on his/her Tracking Chart. All two-part questions must address two of the three card categories. Four examples of two-part questions are given in Table 1.

TABLE 1

| | Part 1 | | Part 2 |
|---|---|---|---|
| 1. Did anyone see a | Vampire | in the | Dining Room? |
| 2. Did anyone hear a | Scream | on the | Balcony? |
| 3. Did anyone see a | Mummy | in the | Tower? |
| 4. Did anyone smell an | Odor | in the | Library? |

All two-part questions require part 1 to recite a card indicia from one or the other of the entity category or the event category. Further, all two part questions require part 2 to recite the card indicia of the place the questioner's game piece is resting upon. For example, in asking Question 1 of Table 1, the questioner's game piece must be resting upon the Dining Room place 112. After asking this two-part question, the in-turn player must then show (face up) a card from his or her hand with indicia of one of the two parts of the two-part question.

Then, every other player, in turn, must play one card from his/her hand, if he/she has a card that allows him/her to do so, by placing a card face-up in front of him/her. The one card that the other players show is in response to either the first part or the second part of the two-part question. For example, if the in-turn player audibly asks Question 1 of Table 1, and then plays his/her Dining Room indicia card, the next player can play either the Dining Room indicia card or the Vampire indicia card. If the Dining Room indicia card is played by another player, it creates a match of played cards, and these matched cards then become discarded or "dead" cards and are placed into the Dead Card Pile container 174. If two other players (neither being the in-turn player) each play their respective Vampire indicia cards, then this matched set of cards become discarded or "dead" cards and are placed into the Dead Card Pile container. Alternatively, if the in-turn player holds both Vampire indicia cards and a Dining Room indicia card, he/she may elect to play (show) either (category) card. If the in-turn player again elects to play the Dining Room indicia card, and should no other player be able to play (show) the Dining Room indicia card, then only the in-turn player knows immediately that the Dining Room indicia card is part of the Haunting Mystery. Other players cannot be sure at this time whether or not the in-turn player holds both Dining Room indicia cards. The other players may suspect that the non-playing of a card to a question or the single play of a card by all the other players to a two-part question may indicate a possibility of a game solution, however, they will only be suspicious at this juncture, because the in-turn player while playing the Dining Room indicia card was also holding both Vampire indicia cards. The only commonly shared veracity of information is when a matched set of cards becomes discarded or "dead." Therefore, early in the game, not all players will have the same information. Notice, though, that as a game of deductive reasoning with finite information, the longer the game is played, and more sets of cards are eliminated, the choices of the "mystery" card indicia becomes narrowed, and the finite information becomes more uniformly distributed among the players. Hence, the longer a game plays, the more desperate becomes the race to get one's game piece into position upon the presumed place of the Haunted House which corresponds to the place indicia of the "mystery" cards upon one's turn so as to able to be first to correctly announce the Haunting Mystery.

No player may play more than one card on any given turn. Any unmatched cards are returned to the players' respective hands.

Players may mark their respective Tracking Chart in any convenient manner, which may include encryption to fool other players who might "take a peek." Marks can include, for example: an "X" for "discarded" or "dead" cards (those cards now in the Dead Card Pile); an "O" for possible choices (those cards returned to players' hands); and an Initial for identifying a player who is holding a certain card.

Play continues, the next turn rotating, preferably to the left, until someone thinks he/she knows the three-part Haunting Mystery. That player must be an in-turn player and be at, or move to, the correct place which is a part of the Haunting Mystery before he/she can announce the Haunting Mystery. A player may not play a card and try to solve the Haunting Mystery on the same turn. The announcement must be said out loud so as to be clearly audible to the other players, and must include clear reference to each card indicia of the "mystery" cards hypothecated by the in-turn player. For example, an in-turn player might say: "There is a laughing werewolf in the belfry!" if that in-turn player thought the Haunting Mystery involved the Werewolf indicia card of the entity card category, the Laughing indicia card of the event card category and the Belfry indicia card of the place card category. This player then looks into the Book of Spells and ascertains if the three cards announced are there, in fact. If not, then this player is out of the game. The "mystery" cards are returned by this player (the indicia thereof still unbeknownst to the other players), and this player turns up any cards he/she was holding in his/her hand so the other players may view them. The remaining players mark their respective Tracking Charts, and play continues. On the other hand, if the cards having indicia of the announcement are in fact present in the Book of Spells, that player wins the game and the game thereupon concludes.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A method of playing a board game, the board game comprising: a game board having a themed depiction thereon, said depiction depicting a plurality of places; a plurality of game pieces; a randomizing instrument which generates a random number upon being actuated; and a deck of cards comprising a first set of cards and a second set of cards, wherein said first and second sets of cards are mutually identical, each of said first and second sets of cards comprising a plurality of cards having thereupon mutually differing indicia, wherein the indicia of each card of said first set has a match to a respective card of the second set, said mutually differing indicia comprising a plurality of categories of indicia including a place category wherein the mutually differing indicia thereof comprise place indicia corresponding to the places, said method comprising the steps of:

a) selecting a card from each category to thereby provide a set of mystery cards, wherein the indicia on each card of the set of mystery cards forms a part of a mystery to be solved by players;

b) secreting the mystery cards, wherein all remaining cards have a respective match except those cards respectively matching the mystery cards;

c) distributing the remaining cards to each player, wherein all distributed remaining cards are matched as between the first and second sets of cards except cards having indicia matching the mystery cards;

d) actuating the randomizing instrument by an in-turn player to thereby provide a random number;

e) moving a game piece of the in-turn player to a selected place of the depiction within a number of places selected responsive to said step of actuating;

f) showing a card by the in-turn player;

g) asking of a multi-part question by the in-turn player, each part of the multi-part question corresponding to an indicia of a card in a category, wherein each part involves a different category from the other part, and wherein only a last part involves the place category;

h) showing of a card having indicia corresponding to a part of the multi-part question by players other than the in-turn player;

i) removing from play all matching shown cards;

j) returning to each respective player all unmatched shown cards;

k) repeating steps d) through j), wherein each player sequentially is the in-turn player until an in-turn player determines which cards held by the players have no indicia match and announces a solution to the mystery, said solution comprising a statement incorporating the indicia of each of the mystery cards.

2. The method of claim 1, further comprising each player selectively marking a respective Tracking Chart with information relevant to solving the mystery.

3. The method of claim 2, wherein said step of moving is performed according to predetermined allowable moves.

* * * * *